US007063038B1

(12) United States Patent
Bilos

(10) Patent No.: US 7,063,038 B1
(45) Date of Patent: Jun. 20, 2006

(54) ROWING SEAT

(76) Inventor: John Bilos, 580 Ruskin, Elk Grove Village, IL (US) 60007

( * ) Notice: Subject to any disclaimer, the term of this patent is extended or adjusted under 35 U.S.C. 154(b) by 123 days.

(21) Appl. No.: 10/246,063

(22) Filed: Sep. 18, 2002

(51) Int. Cl.
*B63B 17/00* (2006.01)

(52) U.S. Cl. ..... 114/363; 114/341

(58) Field of Classification Search ..... 114/363, 114/347
See application file for complete search history.

(56) References Cited

U.S. PATENT DOCUMENTS 1,590,240 A * 6/1926 Gorton ..... 297/423.38
2,645,274 A * 7/1953 Leach ..... 297/352
4,398,766 A * 8/1983 Everett ..... 297/252
5,135,449 A 8/1992 Jones
5,304,107 A 4/1994 Jones
5,597,375 A 1/1997 Simonson
5,957,817 A 9/1999 Koenig
6,264,585 B1 7/2001 Beauchamp

* cited by examiner

*Primary Examiner*—Ed Swinehart
(74) *Attorney, Agent, or Firm*—Vedder Price Kaufman & Kammholz

(57) ABSTRACT

The present invention provides a rowing seat for use in a rowboat. The seat includes a chest and abdomen support designed to provide support and leverage for rowers of rearward facing rowboats. The seat includes a clamp so that it may be removably secured to a rowboat bench. The seat further includes a hinge between the seat and the chest support so that the chest support may be collapsed to a horizontal position when not in use.

4 Claims, 3 Drawing Sheets

ROWING SEAT

BACKGROUND OF THE INVENTION

Many rowboats are designed to be rearward facing. In rearward facing rowboats, the rower faces rearwardly while rowing through the water. The rower guides the end of the oar in the water from the front of the boat, which is behind the rower, to the back of the boat, which is in front of him. Due to the nature of the oarlock system, the rower is essentially pulling his end of the oars toward his chest. A rower must expend considerable energy in maintaining an upright position to avoid straining back muscles.

In such a pulling motion, a rower does not necessarily need support to the back to provide leverage as the rows. The nature of rowing is that a standard seat with a back support impedes the rower's range of motion and does not provide the desirable leverage. Rather, the rower needs support in the chest and abdominal area to provide the necessary leverage as he pulls the oars towards him.

Stationary rowing machines, commonly found in exercise facilities, mimic the conditions and movements associated with rowing a rowboat. A number of such exercise machines are fitted with structures which support the user's chest as the user goes through the rowing movements, for the reasons outline above. U.S. Pat. No. 5,957,817 to Koenig et al. discloses an exercise machine wherein the user stands on a base 16 and pulls a weighted bar 50 towards his chest. A cushioned pad 24 is provided which restrains forward movement. U.S. Pat. No. 6,264,585 to Beauchamp discloses an exercise machine wherein the user sits on a support 105 and pulls a weighted bar 97 towards his chest. A chest pad 106 is provided to restrain forward movement. Nonetheless, there exists a need for an improved seat for rowboats which would provide support for the rower's chest and abdomen while rowing.

SUMMARY OF THE INVENTION

The present invention provides a seat for a rowboat in which a clamp removably attaches the seat to a boat bench. A hinge fixedly attached to the pole support allows seat to be collapsed when not in use. A chest pad is attached to the hinge and is constructed and arranged so that when the chest pad is positioned perpendicular relative to the seat, the chest pad supports a rower's chest and abdomen while in use.

DETAILED DESCRIPTION OF THE INVENTION

Figure 1:
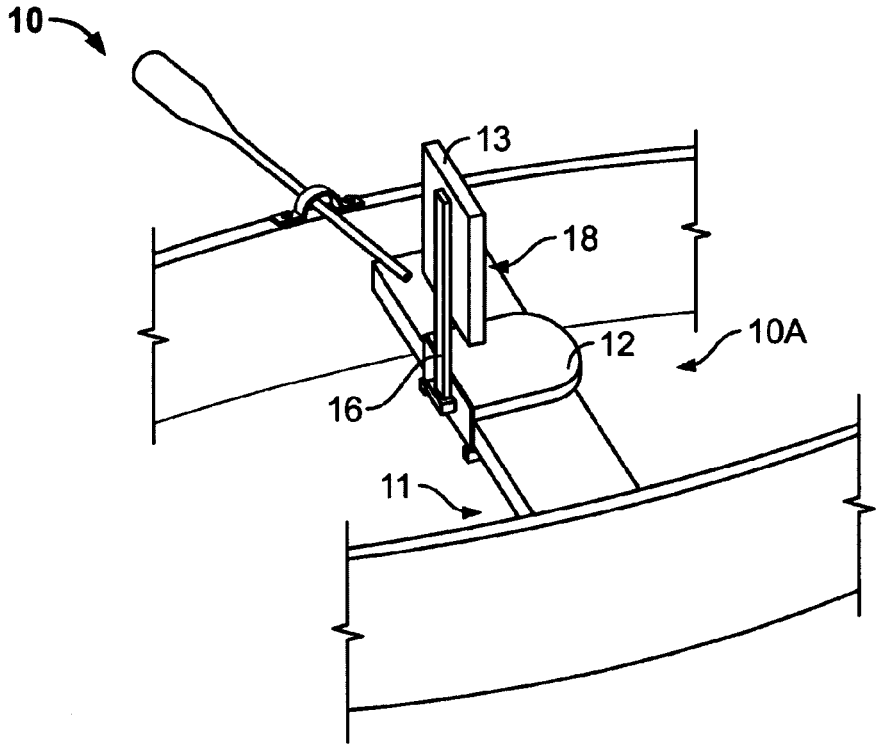
FIG. 1 is a partially cut away perspective view of the seating apparatus installed in a rowboat.
Figure 2:
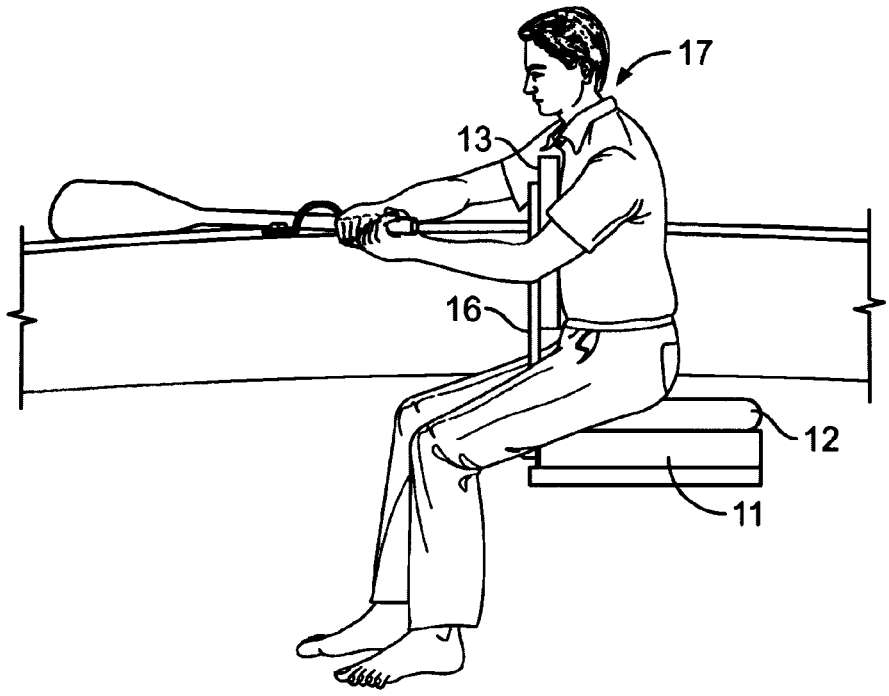
FIG. 2 is a side view of a rower in rowing position.
Figure 3:
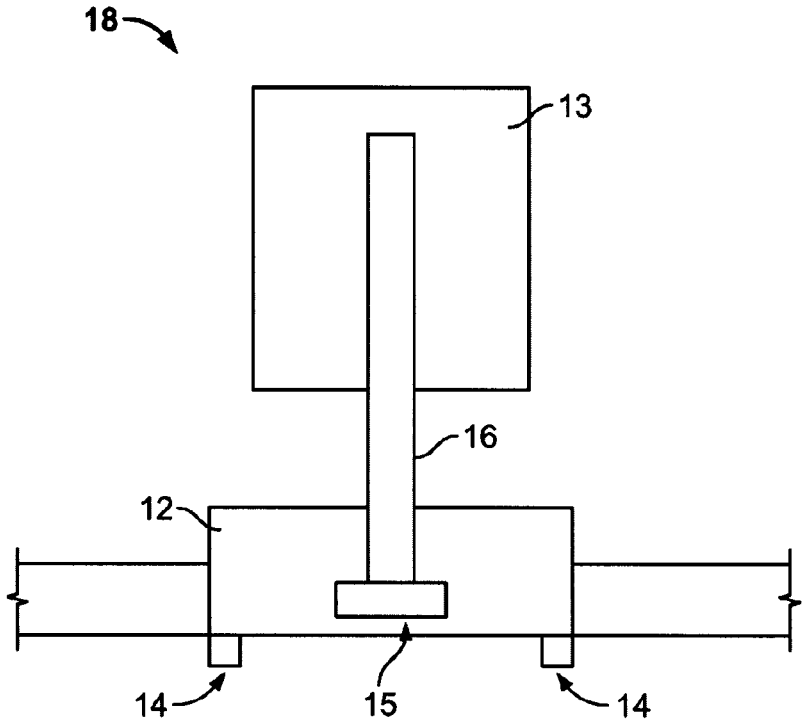
FIG. 3 is a front view of the seating apparatus

A rowboat 10 is shown in FIG. 1. A bench 11 extends perpendicularly to the length of the rowboat 10. Bench 11 is oriented so that a rower 17 faces away from the front 10A of a rowboat 10 when seated on bench 11 in a rowing position as shown in FIG. 2. A seating apparatus 18 is secured to the center of bench 11. Seating apparatus 18 is removably secured to bench 11 with at least one clamp 14. Clamp 14 enables removal of seating apparatus 18 when rowboat 10 is stored away, or when the rower simply wants to row without the benefit of seating apparatus 18. Clamp 14 has a grip 19 which engages bench 11 when in use. Grip 19 is fit onto bench 11 and manually tightened to securely attach seating apparatus 18 to bench 11. It should be appreciated that grip 19 may be constructed and arranged to provide the necessary force to secure seating apparatus 18 to bench 11 in a variety of ways. In various embodiments, grip 19 could be spring loaded, tightened with screws, etc.

A seat 12 is attached using clamp 14 and is arranged to rest flat on bench 11. Seat 12 provides a place for the rower to rest while rowing. In the present embodiment, seat 12 is flat plastic member constructed of thermoplastics, such as polyethylene polypropylene etc., or elastomers such as polyurethane. It is to be understood that seat 12 could be made of wood, plastic, or metal, could be padded, or could be molded into various shapes to satisfy comfort and aesthetic requirements. A hinge 15 is mounted to the front of seat 12. Hinge 15 has a first arm 28 (not shown) which is fixed to the underside of seat 12. Hinge 15 has a second arm 29 which is fixed to a pole support 16. Hinge 15 is oriented so that in a vertical position 22 pole support 16 is maintained in an upright position for use. Hinge 15 may be oriented in a horizontal position (not shown) so that pole support 16 collapses out of the rower's way when chest support 13 is not in use. Hinge 15 includes a locking mechanism 24. Locking mechanism 24 allows hinge 15 to be locked into vertical position 22 while in use.

Figure 4:
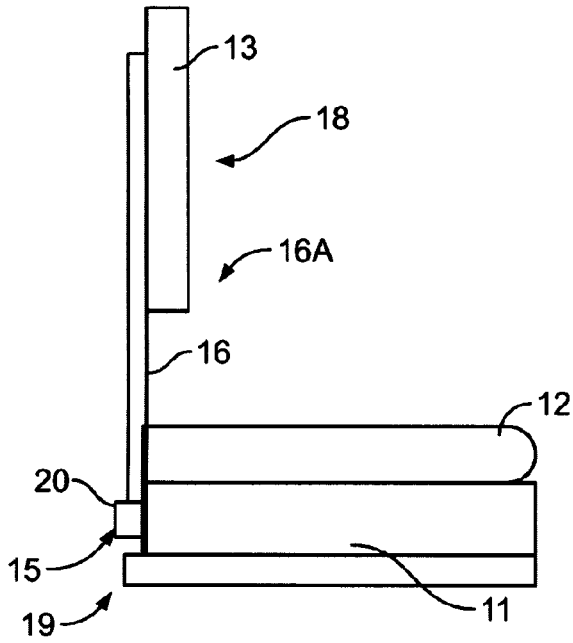
FIG. 4 is a side view of the seating apparatus.
Figure 5:
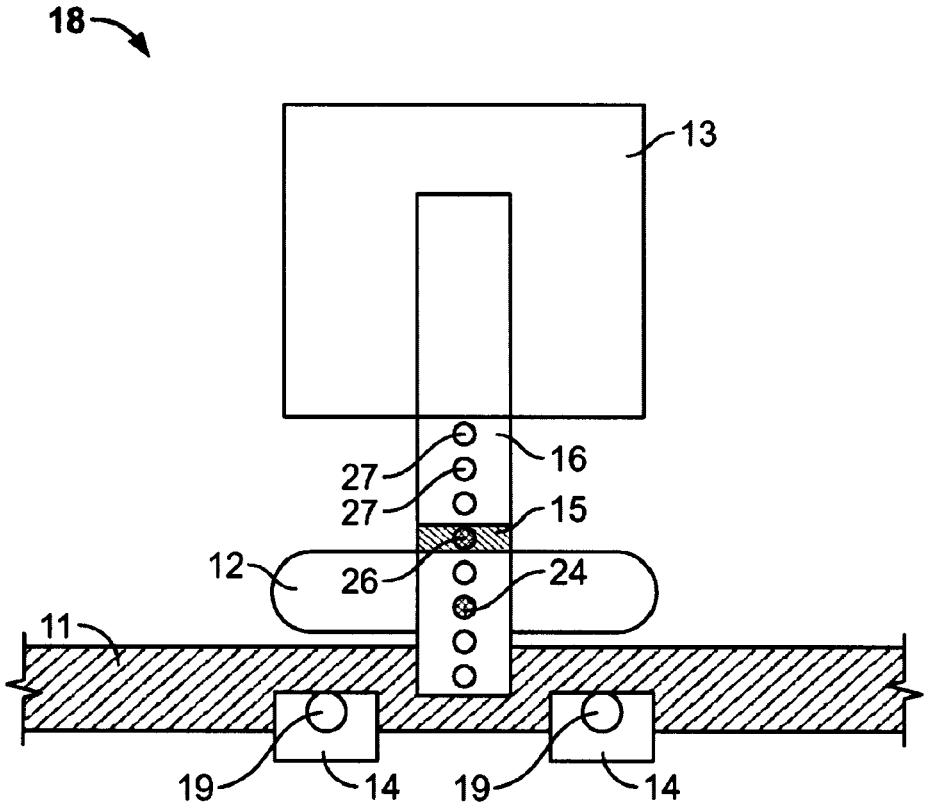
FIG. 5 is an exploded front view of the seating apparatus.

Pole support 16 supports a chest support 13. As shown in FIG. 4, chest support 13 is located on the same side 16A of pole support 16 as seat 12. Referring to FIG. 2, while engaging in a rowing motion, the rower rests on seat 12, straddling pole support 16 with one leg on each side. The rower may then lean against chest support 13 for support and leverage as needed. As shown in FIG. 5, pole support 16 is fit with a pin lock device 25 so that the height of chest support 13 may be adjusted to fit various rower body types. Pin lock device 25 includes a pin member 26 connected to pole support 16. Pin member 26 selectably engages any one of a plurality of holes 27 in support pole 16 to vary the height of chest support 13. In this way, the height of chest support 13 may be adjusted much lower for a child user, or much higher to fit an adult. In other embodiments, pole support 16 may be fitted with alternate means of height adjustment. Instead of a pin locking mechanism, pole support 16 may have screw threads (not shown) and rotate to different heights. In the present embodiment, chest support 13 is shown as a flat plastic member. However, it is to be understood that chest support 13 could be made of a variety of materials, and could be padded or molded into various configurations to satisfy comfort and aesthetic requirements.

What is claimed is:

1. A seat for a rowboat comprising:

a seat;

a clamp for removably attaching the seat to the bottom of a boat bench;

a hinge member fixedly attached to the front of said seat and constructed for selective movement to a plurality of positions including substantially vertical and substantially horizontal relative to said seat and for fixing the position of said hinge in said positions;

a pole support attached to the hinge member and positioned perpendicular to and extending from the longitudinal axis of said seat so as to allow the rower to straddle said pole when in use; and a chest pad fixedly attached to the pole support, said chest pad being constructed and arranged so that when said chest pad is positioned vertically relative to said seat, said chest pad supports a rower's chest and abdomen while in use.

2. The seat of claim 1 wherein the pole support further includes a locking device to allow perpendicular adjustment of the vertical distance between the seat and the chest pad.

3. The seat of claim 2 wherein the hinge member is mounted on at least one of: an inside portion and an outside portion of the pole support.

4. The seat of claim 1 wherein the hinge member further includes a locking device to selectively lock the hinge member into at least one of: the substantially vertical position and the substantially horizontal position.

* * * * *